US007397435B2

(12) United States Patent
McEwan

(10) Patent No.: US 7,397,435 B2
(45) Date of Patent: Jul. 8, 2008

(54) QUICK RELEASE STOWAGE SYSTEM FOR TRANSPORTING MOBILE SATELLITE ANTENNAS

(75) Inventor: George Tyler McEwan, Centerville, UT (US)

(73) Assignee: Winegard Company, Burlington, IA (US)

( * ) Notice: Subject to any disclaimer, the term of this patent is extended or adjusted under 35 U.S.C. 154(b) by 463 days.

(21) Appl. No.: 11/248,833

(22) Filed: Oct. 11, 2005

(65) Prior Publication Data

US 2006/0038728 A1 Feb. 23, 2006

Related U.S. Application Data

(63) Continuation-in-part of application No. 11/195,975, filed on Aug. 3, 2005, now Pat. No. 7,230,581.

(60) Provisional application No. 60/618,015, filed on Oct. 12, 2004, provisional application No. 60/601,362, filed on Aug. 13, 2004.

(51) Int. Cl.

| | |
|---|---|
| ***H01Q 1/32*** | (2006.01) |
| ***H01Q 3/00*** | (2006.01) |
| ***H01Q 1/42*** | (2006.01) |
| ***H01Q 3/02*** | (2006.01) |

(52) U.S. Cl. ..... 343/713; 343/757; 343/872; 343/882

(58) Field of Classification Search ..... 343/711, 343/713, 757, 761, 766, 872, 882
See application file for complete search history.

(56) References Cited

U.S. PATENT DOCUMENTS

| | | | | |
|---|---|---|---|---|
| 3,412,404 | A | 11/1968 | Bergling | |
| 3,646,564 | A | 2/1972 | Drislane | |
| 4,663,633 | A | 5/1987 | Wilson | |
| 4,725,843 | A | 2/1988 | Suzuki et al. | |
| 4,771,293 | A * | 9/1988 | Williams et al. | 343/757 |
| 4,811,026 | A | 3/1989 | Bissett | |
| 4,873,526 | A | 10/1989 | Katsuo | |
| 4,887,091 | A | 12/1989 | Yamada | |
| 4,994,816 | A | 2/1991 | Kondo | |
| 5,337,062 | A * | 8/1994 | Sherwood et al. | 343/711 |
| 5,418,542 | A | 5/1995 | Sherwood et al. | |
| 5,515,065 | A | 5/1996 | Sherwood et al. | |
| 5,528,250 | A | 6/1996 | Sherwood et al. | |
| 5,554,998 | A | 9/1996 | Sherwood et al. | |
| 5,646,638 | A | 7/1997 | Winegard et al. | |
| 5,760,751 | A | 6/1998 | Gipson | |
| 5,929,817 | A | 7/1999 | Clark | |
| 5,952,980 | A | 9/1999 | Boling | |
| 5,966,104 | A | 10/1999 | Massey et al. | |
| 5,999,139 | A | 12/1999 | Benjamin et al. | |
| 6,124,836 | A | 9/2000 | Rogers | |
| 6,462,718 | B1 | 10/2002 | Ehrenberg et al. | |
| 6,507,324 | B2 * | 1/2003 | Overton et al. | 343/840 |

(Continued)

*Primary Examiner*—Shih-Chao Chen
(74) *Attorney, Agent, or Firm*—Dorr, Carson & Birney, P.C.

(57) ABSTRACT

A mobile satellite antenna system has a first portion that includes an elevation mechanism, and a second portion that includes a dish with a dish back support structure. These portions can be readily connected or disconnected by a set of quick-connect fasteners that selectively fasten the elevation mechanism of the first portion to the dish back support structure of the second portion. Both portions of the satellite antenna system can be separately stored and transported in containers.

12 Claims, 16 Drawing Sheets

U.S. PATENT DOCUMENTS

| | | | |
|---|---|---|---|
| 6,535,177 | B1 | 3/2003 | Dhellemmes et al. |
| 6,573,871 | B2 | 6/2003 | Drews et al. |
| 6,714,170 | B2 | 3/2004 | Kleinschmidt |
| 6,734,830 | B1 | 5/2004 | Bickham |
| 2004/0077309 | A1 | 4/2004 | Brass et al. |
| 2004/0125035 | A1 | 7/2004 | Noro et al. |
| 2004/0160375 | A1 | 8/2004 | King |

* cited by examiner

QUICK RELEASE STOWAGE SYSTEM FOR TRANSPORTING MOBILE SATELLITE ANTENNAS

RELATED APPLICATIONS

The present application is based on and claims priority to the Applicant's U.S. Provisional Patent Application 60/618,015, entitled "Quick Release Stowage System For Transporting Mobile Satellite Antennas," filed on Oct. 12, 2004. The present application is also a continuation-in-part of the Applicant's U.S. patent application Ser. No. 11/195,975, entitled "Nomadic Storable Satellite Antenna System," filed on Aug. 3, 2005, now U.S. Pat. No. 7,230,581 which was based on U.S. Provisional Patent Application 60/601,362 filed on Aug. 13, 2004.

BACKGROUND OF THE INVENTION

1. Field of the Invention

The present invention relates to a high bandwidth uplink/downlink mobile satellite antenna system that can be quickly disassembled, stowed, and transported to another location.

2. Background of the Invention

The mobile satellite antenna market is growing due to the increased demand for high bandwidth communication between a remote location and a satellite (e.g., commercial users such as those found in the oil and gas industry where use locations are far apart). Some users of mobile satellite antennas require high speed deployment of the satellite antenna such as those, for example, in the law enforcement community with tactical communications vehicles. Military and homeland security units have the same requirement. In some geographical areas, the mobile satellite antenna is required to move through heavy snow loads in its deployment.

A number of conventional satellite antenna systems are available that fold down when not in operation. Conventionally, either gear boxes are used in such conventional systems to elevate the dish through a rotary drive motion, or a linear actuator attached to the back of the satellite dish is used to raise the dish by pivoting on a cardanic joint. Examples of such commercially available devices are found in U.S. Pat. Nos. 5,337,062, 5,418,542 and 5,528,250. In addition, such conventional satellite antenna systems are available from MotoSat and C-Com Satellite Systems, Inc.

A need exists to move the satellite antenna system from a stowed position to a usable deployed position as quickly as possible and to overcome any lethargic mechanical performance. Conventional drive gear box designs are slower in operation and suffer from an undesirable condition called gear backlash that may adversely affect data transmission and use of the dish. A conventional linear actuator, at the attachment point on the satellite dish, provides a limited range of elevation motion and cannot be used in every region of the world.

A need exists for a stowable/deployable satellite antenna system that does not encounter excessive backlash as found in gear box designs and does not limit the range of elevation as found in cardanic joint-based actuators. A further need exists to rapidly deploy the satellite antenna system. Another need exists to deploy the satellite antenna system under heavy loads such as found when heavy snow accumulates on the stowed antenna and the antenna must be deployed through the heavy snow load.

A still further need exists to be able to quickly disassemble, stow and transport the satellite antenna of the present invention so that it can be used in various remote locations. This is especially required when the antenna is used by the military or on scientific expeditions. The ability to rapidly move and deploy the antenna to a new location becomes of critical importance.

SUMMARY OF THE INVENTION

This invention provides a mobile satellite antenna system having a first portion that includes an elevation mechanism, and a second portion that includes a dish with a dish back support structure. These portions can be readily connected or disconnected by a set of quick-connect fasteners that selectively fasten the elevation mechanism of the first portion to the dish back support structure of the second portion. Each portion of the satellite antenna system can be separately stored and transported in a container.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
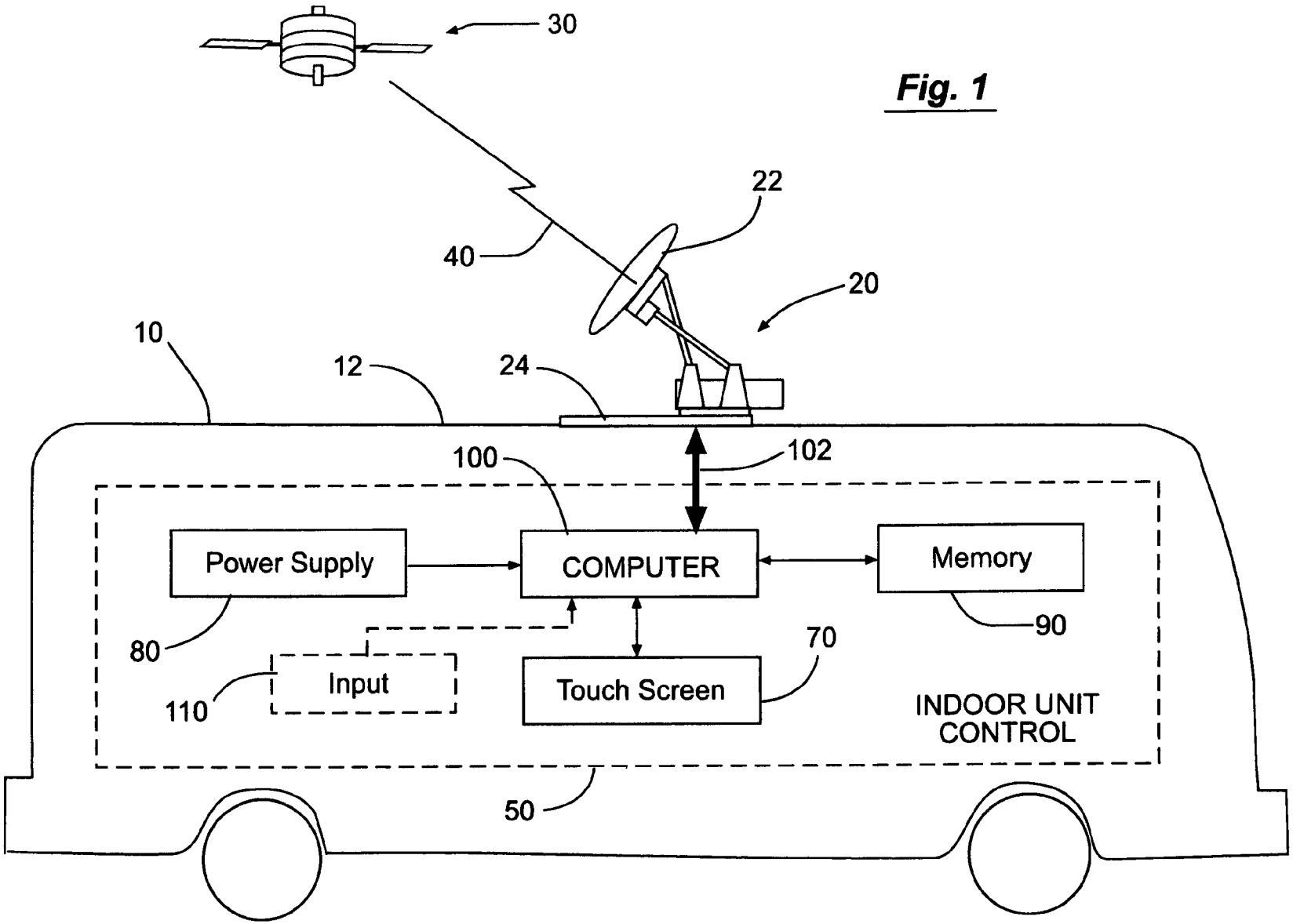
FIG. 1 shows the satellite antenna system 20 of the present invention mounted to a vehicle in operational use.

Overview of Use. In FIG. 1, a vehicle 10 is shown having a roof-mounted satellite antenna system 20 in communication with a satellite 30 to broadcast and receive signals 40. In the interior of the vehicle 10 is an indoor unit control 50 for controlling over cable(s) 102 the operation of the satellite antenna system 20 and the communication with the satellite 30. The indoor unit control 50 has a computer 100, a touch screen 70, and a power supply 80. These components are conventionally available and are suitably designed to work with other hardware interfaces and software controls to conventionally stow and deploy the dish antenna 22 of the satellite antenna system 20 that is mounted 24 to the roof 12 of the vehicle 10. The accompanying drawings illustrate a conventional dish antenna 22, but it should be understood that other types of satellite antennas could be used in the present invention.

It is to be understood that a number of different conventional indoor unit controls 50 are available to control a number of different satellite antenna systems 20. The present invention is vigorous in that it can be adopted to work with any such conventional system to secure access for deployment and stowing of the satellite antenna system 20 on the vehicle 10.

Figure 2:
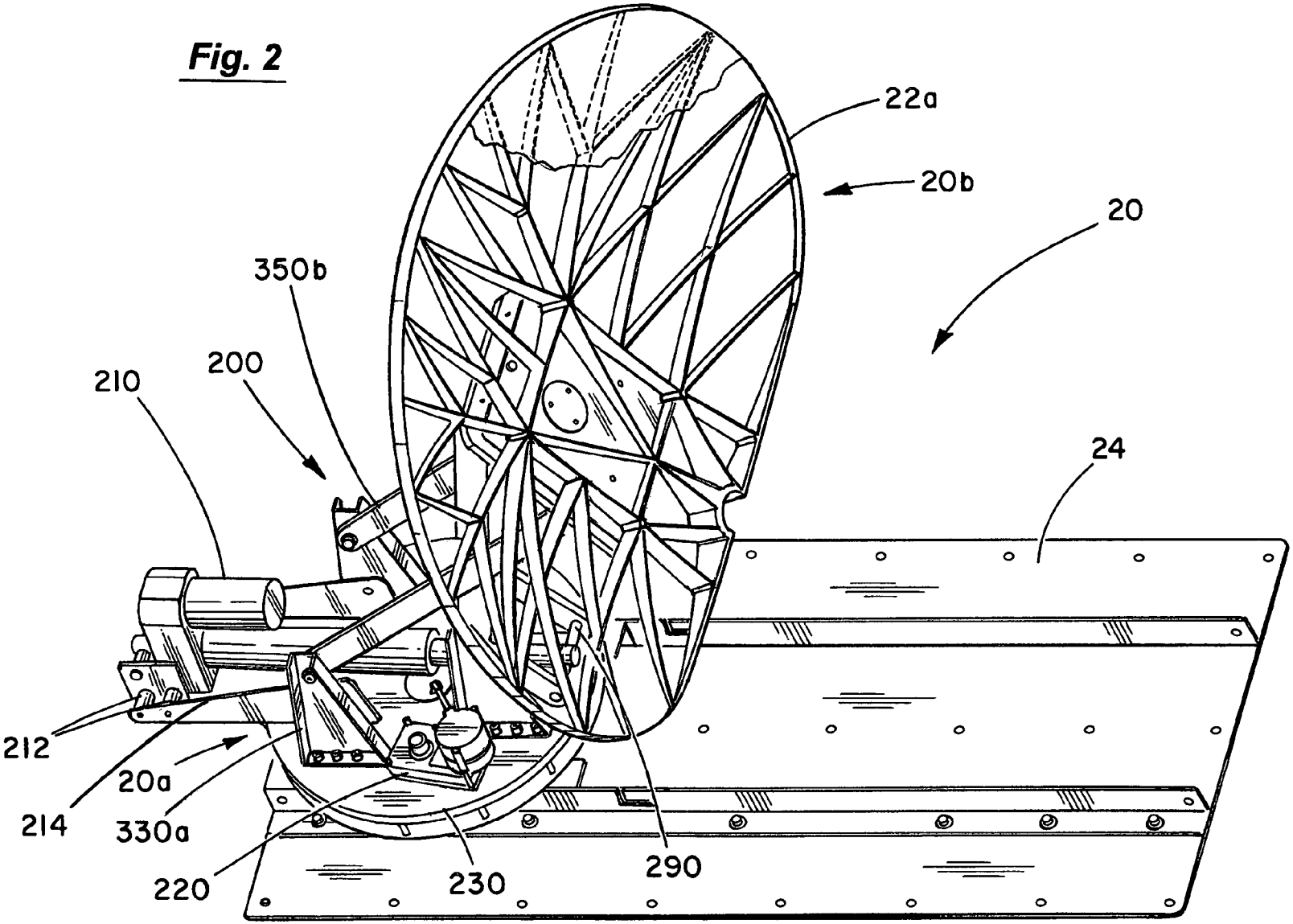
FIG. 2 is a perspective view of the elevation mechanism 200 of the present invention mounted in a satellite antenna system.

Overview of Satellite Dish Antenna. In FIG. 2, the details of the satellite antenna system 20 are shown without the dish 22 being shown. The dish back structure 22*a* for the dish 22 connects to the elevation mechanism 200 of the present invention. A linear actuator 210 is used to deploy and stow the dish 22 mounted to the dish back structure 22*a*. The linear actuator 210 is conventionally connected to a bracket 214 on the movable azimuth plate 230 such as with a steel link pin 212. An azimuth drive motor 220 is connected directly to the movable azimuth plate 230. The azimuth plate 230 provides a stable mounting platform for all of the elevation mechanism 200 components and is designed to rotate 360° freely about a center axis so as to provide a full 360° rotational travel for the satellite antenna system 20. It should be understood that other means for mounting the satellite antenna system 20 could be readily substituted for the azimuth drive motor 200. In general terms, the satellite antenna system 20 can be mounted to any type of base.

Figure 3:
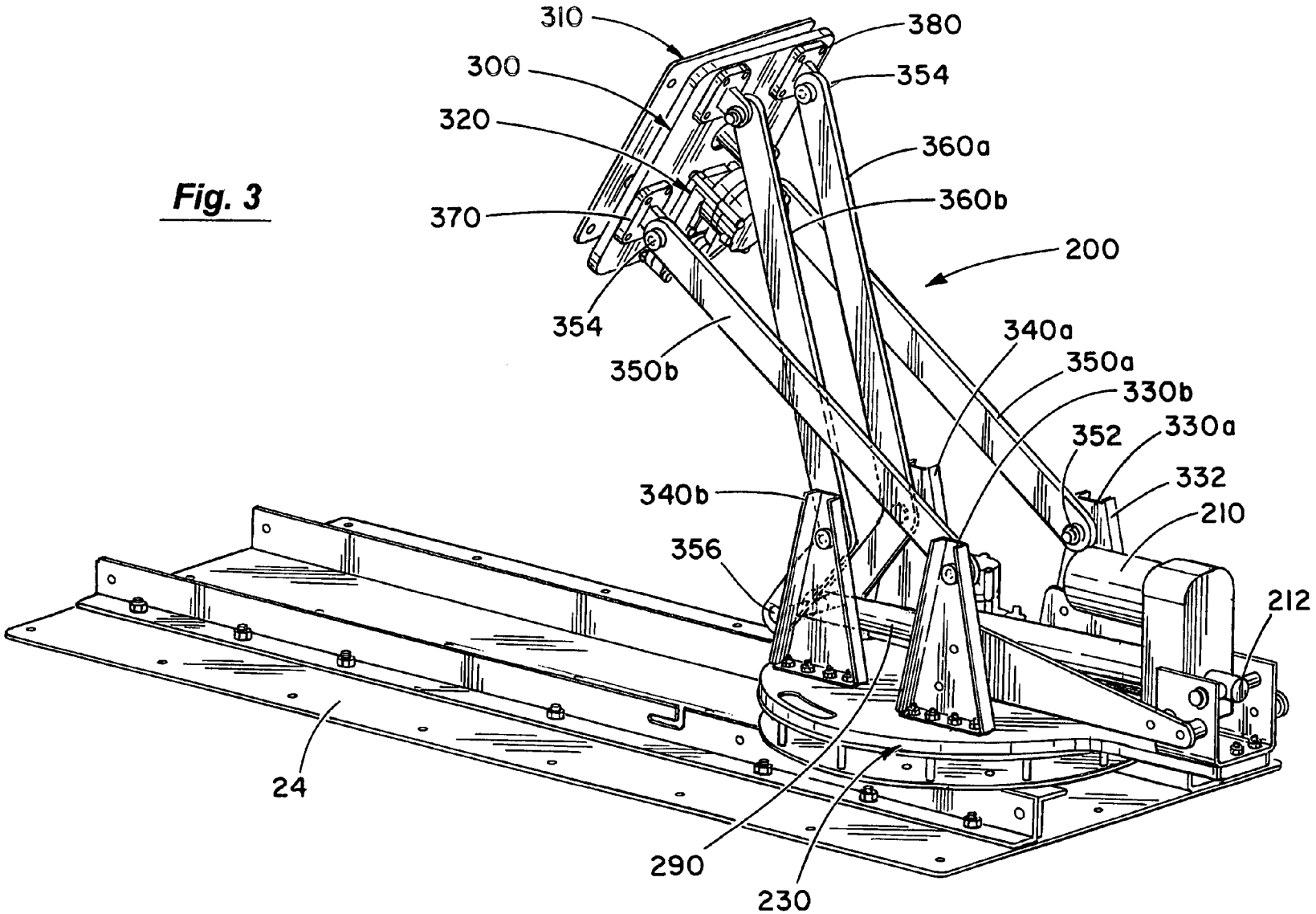
FIG. 3 is a perspective illustration of the elevation mechanism 200 of the present invention mounted to the azimuth plate of a satellite antenna system.

As shown in FIG. 3, the elevation mechanism 200 is shown connected at one end to a dish back plate 300 that carries a skew plate 310 that is designed to rotate about the center axis of the dish back plate 300. The rotation is caused by a skew motor 320 that is mounted to the dish back plate 300. The mechanical output shaft of the skew motor 320 is connected to the skew plate 310 to drive the skew plate 310 about the third axis of movement required for operation of the satellite antenna system 20. A cable 322 connects to the skew motor 320. The dish back structure 22*a* for the satellite antenna system 20 is mounted to the skew plate 310.

In the above embodiment, the details of the mounting plate 24, the movement of the dish antenna 22 in the azimuth direction by means of the azimuth plate 230, and the movement of the dish under control of the skew motor 320 can be of any of a number of suitable designs and are not limited to that shown here which for purposes of the present disclosure is illustrated. The elevation mechanism 200 of the present invention will now be explained in greater detail.

Elevation Mechanism. In FIG. 3, the elevation mechanism 200 of the present invention is shown mounted to the azimuth plate 230 (or base) by means of two opposing tilt pivot brackets 330*a* and 330*b* and two opposing lift pivot brackets 340*a* and 340*b*. The tilt pivot brackets 330*a* and 330*b* oppose each other and function to precisely locate the tilt link bars 350*a* and 350*b*, which are used to create pivoting motion to the dish 22 during movement between the stowed position and the deployed position. Each tilt pivot bracket 330*a* and 330*b* is generally triangular in shape, and the base of each triangle is mounted to the azimuth plate 230. How the pivot brackets 330*a* and 330*b* are mounted to the azimuth plate 230 is immaterial as any of a number of conventional approaches can be utilized including the four bolted connections shown in FIG. 3. Each tilt pivot bracket 330*a* and 330*b* has extending sides 332 around the periphery to provide rigidity for the bracket 330*a*, 330*b*. Each tilt link bar 350*a* and 350*b* is pivotally connected 352 to its corresponding tilt pivot bracket 330*a* or 330*b*. Again, any of a number of conventional pivot connections 352 can be utilized to provide pivotal movement between each tilt link bar 350*a*, 350*b* and each tilt pivot bracket 330*a*, 330*b*.

Figure 5:
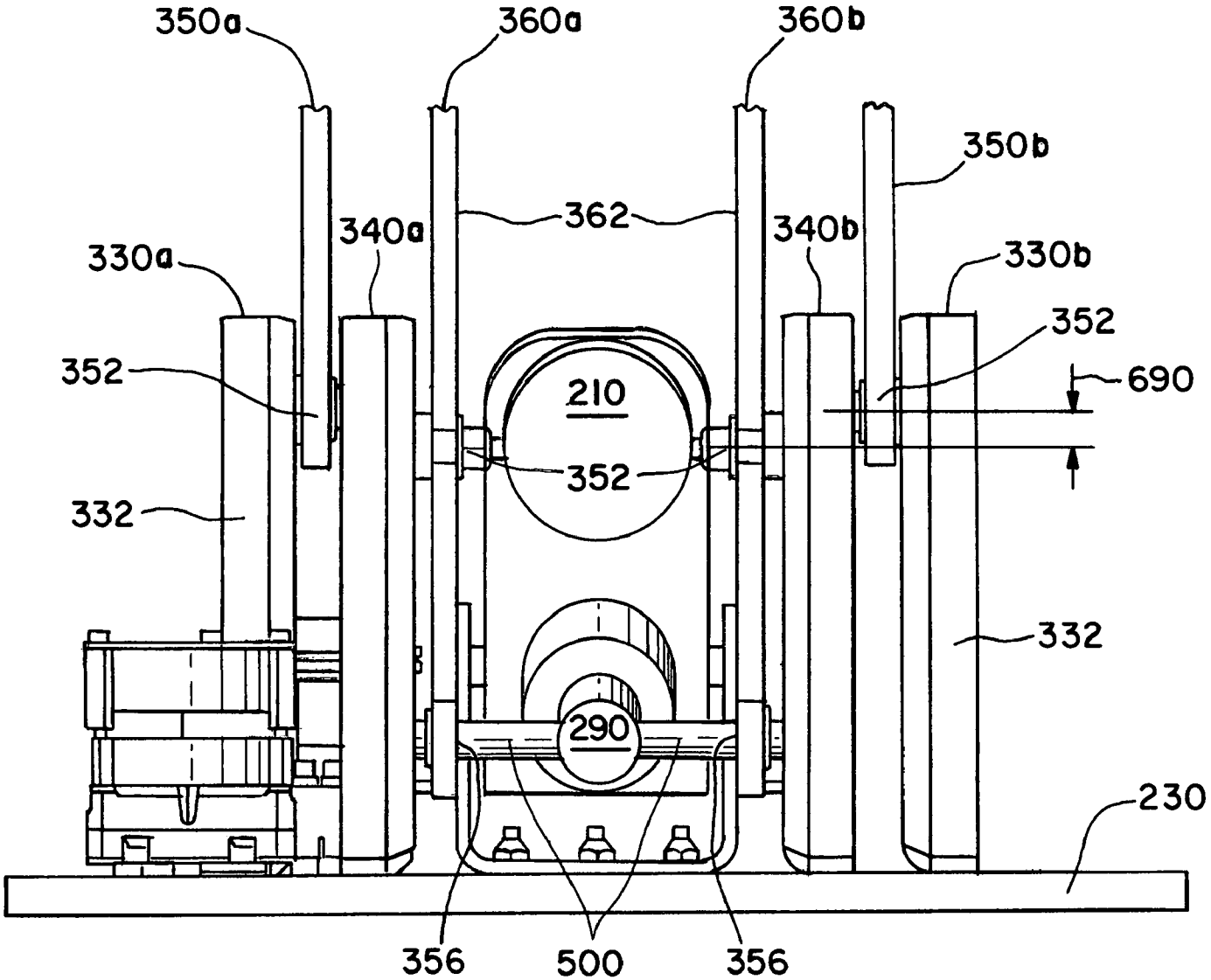
FIG. 5 is a side planar view of the elevation mechanism 200 of the present invention mounted to the azimuth plate of a satellite antenna system.
Figure 6:
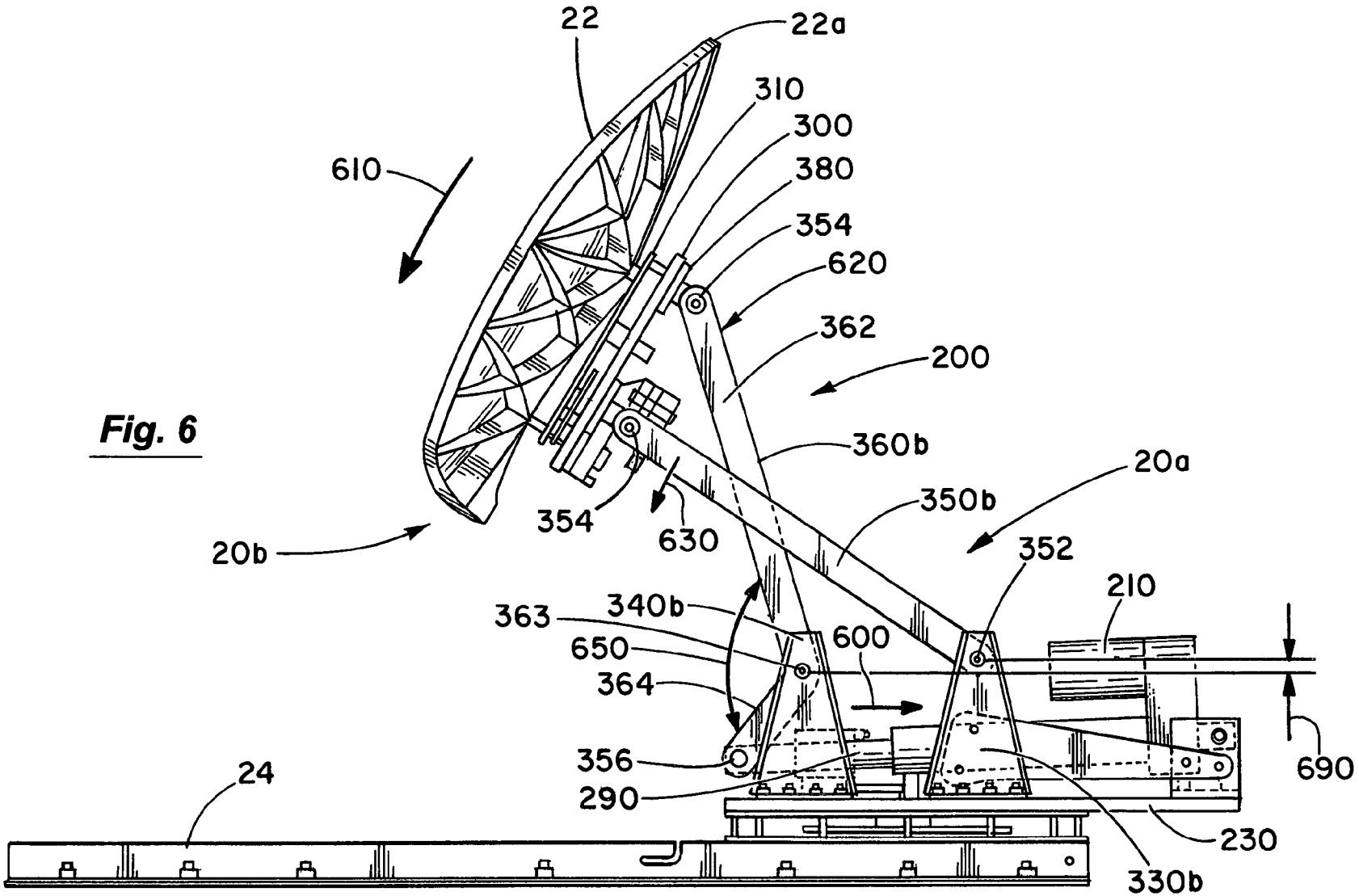
FIG. 6 is a side planar view of the elevation mechanism 200 deploying the satellite antenna system.

Likewise, each lift pivot bracket 340*a* and 340*b* is of the same or similar design as each tilt pivot bracket 330*a* and 330*b* and is connected to the azimuth plate 230 (or base) in the same or similar fashion. However, the tilt pivot connection point 352 location is higher 690 (as shown in FIGS. 5 and 6) than the lift pivot connection point 363. A mathematical relationship exists between the two separate pivot locations to provide proper pivoting and lifting. Each lift bar 360*a* and 360*b* of the elevation mechanism 200 is connected to respective lift pivot brackets 340*a* and 340*b* in the same or similar fashion as the connection of the tilt link bars 350*a* and 350*b* to the respective tilt pivot brackets 330*a* and 330*b*. The lift pivot brackets 340*a* and 340*b* are located precisely on the azimuth plate 230 (or base) with the function of providing a pivot location for the lift bars 360*a* and 360*b* in the elevation mechanism 200.

Figure 4:
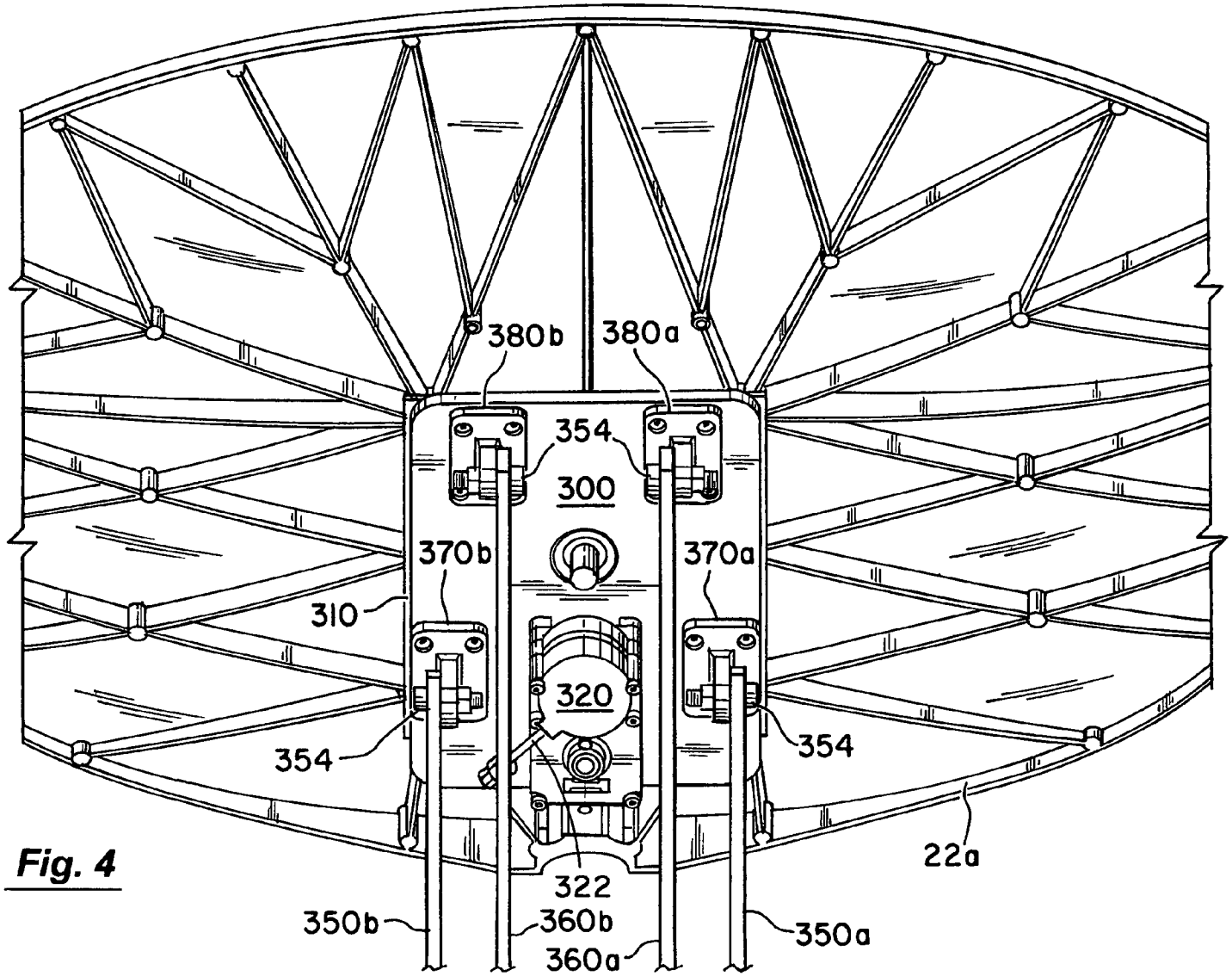
FIG. 4 is a side planar view of the connection of the elevation mechanism 200 to the dish back plate.

Each tilt link bar 350*a* and 350*b* is an elongated substantially rectangular mechanical arm having curved ends as shown in FIG. 3. At each end of each tilt link bar 350*a*, 350*b* is a hole, not shown, through the bar that cooperates with pivot connection 352 at the end of the bar that connects to the tilt pivot brackets 330*a* and 330*b*. A hole at the opposite end of each tilt link bar 350*a*, 350*b* cooperates with a second pivot connection 354. This second pivot connection 354 is to a rigid upstanding dish back plate pivot bracket 370 firmly attached to the dish back plate 300 as shown in FIG. 4. Each dish back plate pivot bracket 370 is firmly connected to the dish back plate 300 in any of a number of conventional fashions. The connections could include, for example, a bolted connection, a welded connection, an integral connection such as die cast part, etc.

It can be observed in FIG. 3 that the two lift bars 360*a* and 360*b*, in this embodiment, are disposed between the two tilt link bars 350*a* and 350*b*. This is better shown in FIG. 4. Likewise, in FIG. 5, the positioning of the lift bars 360*a* and 360*b* inside of the tilt link bars 350*a* and 350*b* is shown with respect to the pivotal connection 352 to the tilt pivot brackets 330*a* and 330*b* and to the lift pivot brackets 340*a* and 340*b* that are mounted to the azimuth plate 230. In another embodiment, the tilt link bars 350*a* and 350*b* are located inside the lift bars 360*a* and 360*b*. It should be understood that the number and relative locations of the lift bars 360*a*, 360*b* and tilt link bars 350*a*, 350*b* are largely matters of design choice. For example, an elevation mechanism could be constructed with two tilt link bars 350*a*, 350*b* and only one lift bar.

In the embodiment of the present invention shown in the accompanying figures, each lift bar 360*a* and 360*b* comprises two bar segments 362 and 364 (e.g., as shown in FIGS. 5 and 6). Segments 362 and 364 are integral in each bar 360*a* and 360*b*. Where the two segments 362 and 364 meet is located the formed hole, not shown, corresponding to the pivot connection point 363. With reference to the lift bar that is shown as 360*b* in FIG. 6, the angular relationship between the two segments 362 and 364 is shown. Preferably, an obtuse angle 650 exists between the two segments 362 and 364. The end of segment 364 has a formed hole, not shown, cooperating with a pivot connection 356 that connects to the drive 290 of the linear actuator 210. However, it should be understood that an obtuse angle between the two segments 362 and 364 is not necessary. For example, the segments 362, 364 could be co-linear.

Figure 7:
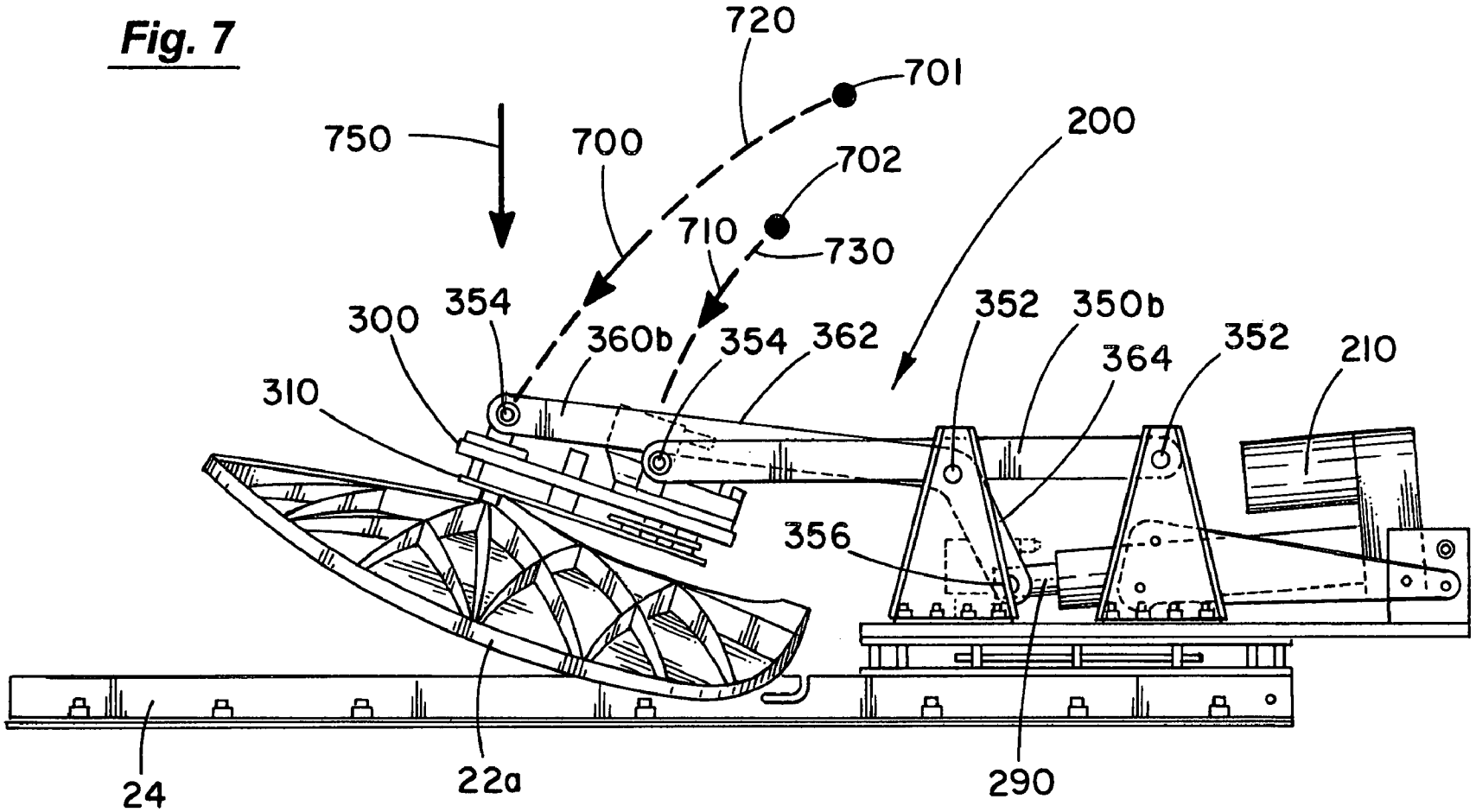
FIG. 7 is a side planar view of the elevation mechanism 200 of the present invention stowing the satellite antenna system.

Operation. With references to FIGS. 6 and 7, the operation of the elevation mechanism 200 is set forth. When the drive 290 of the linear actuator 210 moves in a direction of arrow 600 (FIG. 6) (i.e., substantially parallel to the plane of the azimuth plate 230) the dish back structure 22*a* moves in the direction of arrow 610 until the dish 22 is stowed against or near the mounting bracket 24 as shown in FIG. 7. Action of the drive 290 in the direction of arrow 600 under control of the linear actuator 210 provides a force on lift bars 362*a* and 362*b* in the direction of arrow 620, which causes rotation of the lift bars about the pivot connection point 363 to pull the dish back structure 22*a* in the direction of arrow 610. This force 620 in turn causes a similar force 630 on the tilt link bars 350*a* and 350*b* at pivot point 354. Hence a controlled movement in the direction of arrow 600 occurs until the stowed position of FIG. 7 is obtained. Movement of the drive 290 under control of the linear actuator 210 in the opposite direction of arrow 600 deploys dish back structure 22*a* until the position of deployment shown in FIG. 6 is obtained (or any other desired angle of deployment).

In FIG. 7, arrows 700 and 710 show the paths 720 and 730, respectively, of the ends of bars 360 and 350 at pivot points 354, respectively. The end of the tilt link bar 350*b* (as represented at connection point 354 in FIG. 7) travels along path 730 as shown by arrow 710 to the stowed position from the deployed position 702 of FIG. 6. Likewise, the end of lift bar 360*b* (at pivot point 354) travels along path 720 as shown by arrow 700 from the deployed position 701 of FIG. 6 to the stowed position of FIG. 7.

Also shown in FIG. 7 is a force 750 that could in the normal situation simply be the force of gravity exerting downwardly on the elevation mechanism 200 of the present invention. This force 750, in the case of gravity, is a constant force applied downwardly on the elevation mechanism 200 not only in the stowed position of FIG. 7 but also in the deployed position of FIG. 6.

This force 750 acts to keep any mechanical tolerances (or mechanical slack) constantly biased in the same direction, which therefore does not have to be compensated for when targeting onto a satellite nor does the force 750 impede the quick deployment of the satellite antenna system 20 from the stowed position of FIG. 7 to the deployed position of FIG. 6. In the situation in which the force 750 is greater than the force of gravity due to, for example, a heavy snow load, the present invention through use of the linear actuator 210 lifts against the heavy snow load to place the satellite antenna system 20 in the deployed position of FIG. 6. Each lift bar 360*a* and 360*b* has the angular relationship 650 between segments 362 and 364. Segment 364 is shorter, and a mechanical disadvantage is created between the linear actuator 210 and the dish 22. This allows segment 362 to be as long as possible. The result is a thrust loss due to shorter segment 364. For example, if the lift actuator 210 provides a 500-pound thrust, the lift at the dish 22 is 80 pounds of usable thrust. The dish 22 and the snow load, however, are less than the total lifting capacity of the satellite antenna system 20, so the dish 22 is lifted up. And as the dish 22 goes up, the snow sloughs off the back of the dish 22, making the mechanical load lighter as the satellite antenna system 20 continues up thereby improving the situation.

The connection of the drive 290 to the lower segment 364 of each lift bar 360*a* and 360*b* is best shown in FIG. 5. Here, the drive 290 of the linear actuator 210 is connected to a link pin 500 the ends of which engage in a pivot connection 356 with segments 364. Again, any of a number of conventional connections other than the link pin 500 could be used to provide a pivotal connection 356 between the drive 290 and the lower segments 364.

It is to be expressly understood that the present invention details the operation of the elevation mechanism 200 of the present invention in a satellite antenna system 20 and that the details of the mechanical movement in the azimuth direction, the skew movement and the actual satellite dish 22 have been illustrated and that any of a number of suitable different actual designs could be incorporated and used with the elevation mechanism 200 of the present invention. Furthermore, details of the elevation mechanism 200 of the present invention have been set forth in the drawings and discussed above with respect to one embodiment and it is to be expressly understood different mechanical embodiments could be used in accordance with the teachings of the present invention.

Transportation and Stowage. As shown in FIGS. 9-15, the satellite antenna system 20 according to the present invention can be broken down into two major portions 20*a* and 20*b*. The first portion 20*a* is the elevation mechanism 200 which includes the azimuth plate 230, linear actuator 210, and linkage bars 350 and 360 (i.e., lift bars 360*a*, 360*b* and the tilt link bars 350*a*, 350*b*). The second portion 20*b* includes the dish antenna 22, dish back support structure 22*a* along with dish back plate 300 and skew plate 310. As can be seen in FIG. 3 and as previously discussed, these two portions 20*a* and 20*b* are connected together by fasteners 354 which connect the distal ends of the linkage bars 360, 350 to the dish back plate 300. In one embodiment, the mounting bracket 24 is normally attached to the associated vehicle and therefore does not constitute a required element of the satellite antenna system 20. In another embodiment, the first portion 20*a* is supported by a portion of a transportable container when the antenna is deployed for operation.

The satellite antenna system 20 of the present invention is relatively lightweight and therefore can be easily stowed and transported as desired. This need to transport the satellite antenna is especially required when the antenna is used by the military or on scientific expeditions. For these reasons the ability to rapidly move and deploy the antenna system to various locations becomes of major importance.

Figure 9:
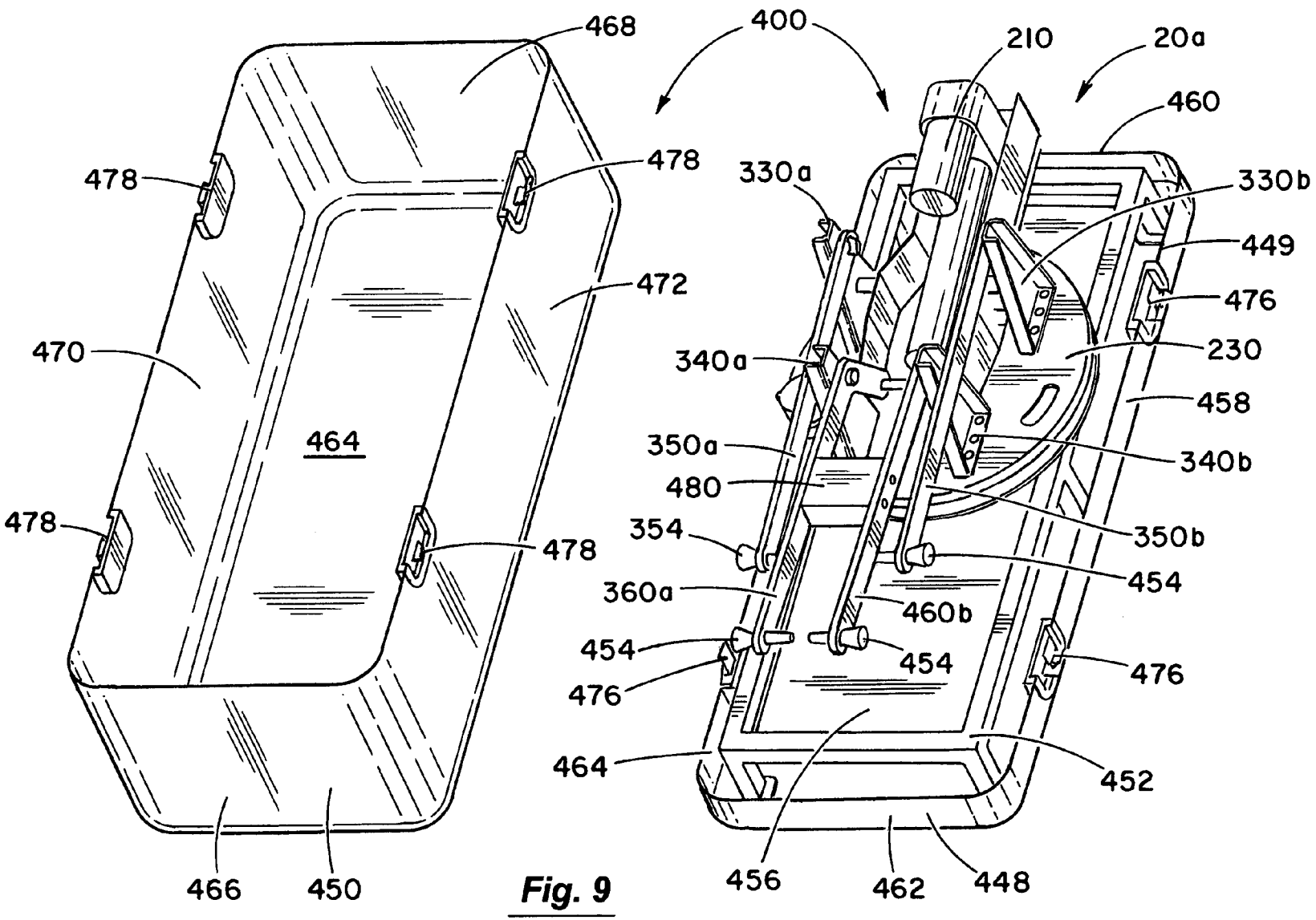
FIG. 9 is a perspective view of the separated base portion of the satellite antenna system of the present invention mounted in a first transportable container.
Figure 10:
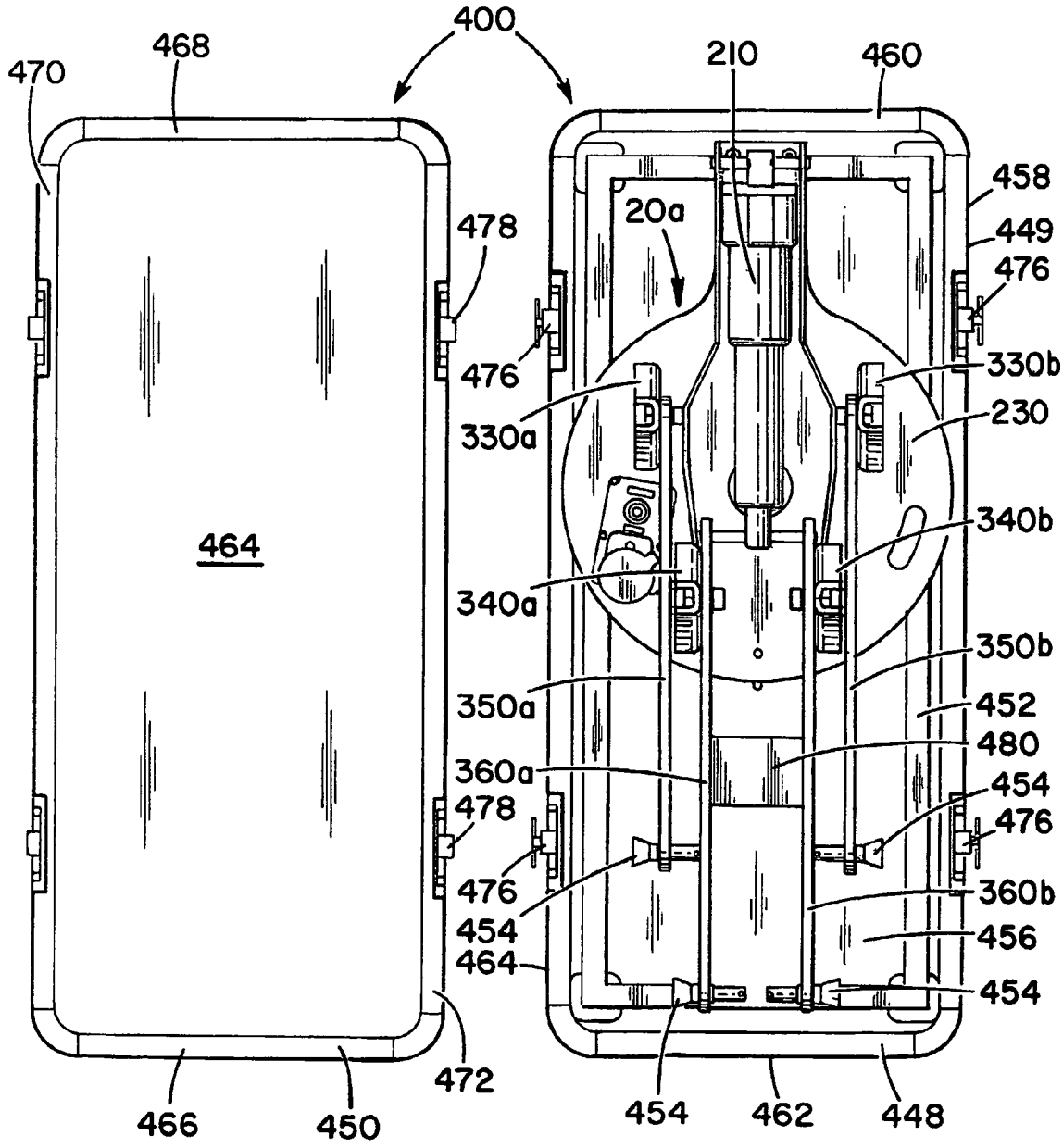
FIG. 10 is a top plan view of the mounted base portion and container shown in FIG. 9.

This capability can be easily accomplished by replacing the fasteners 354 connecting the linkage bars 350, 360 to the dish back plate 300. By substituting quick-disconnect pins or fasteners 454 as shown in FIGS. 9 and 10 the two major portions 20*a* and 20*b* of the satellite antenna system 20 can be easily and quickly separated. The quick-disconnect fasteners 454 can be any of the common type such as a push type pin which has an enlarged head and a spring-loaded rod passing from the head through the barrel of the fastener. The push rod can have a reduced diameter portion which can be aligned with balls positioned in opposed holes or protrusions extending partially outward from the surface of the barrel so that when the reduced diameter portion of the push rod is aligned with the protrusions, the protrusions are released and retracted into the barrel of the fastener. In this way the fastener can be easily inserted and removed from the link bars and their associated attachment brackets mounted on the dish back plate 300.

Other types of fasteners can be used such as a fastening pin having a circumferential slot formed near the outer end of the pin wherein a spring clip can be inserted into the slot once the fastener has been installed. In the alternative, a removable cotter key can be inserted through a diametrically positioned hole near the end of the fastener to retain the fastener in position yet allow the fastener to be quickly removed when desired. It is understood that any type of quick-disconnect fastener can be used to secure the two portions 20*a* and 20*b* of the satellite antenna system 20 together during operational usage. In addition to the fasteners 454, it is also necessary to disconnect the electrical cable 322 connecting the skew motor 320 to the elevation mechanism 200 as well as other signal and power cables. Instead of using a standard electrical cable connector, a quick-disconnect bayonet-type cable receptacle can be provided.

Figure 11:
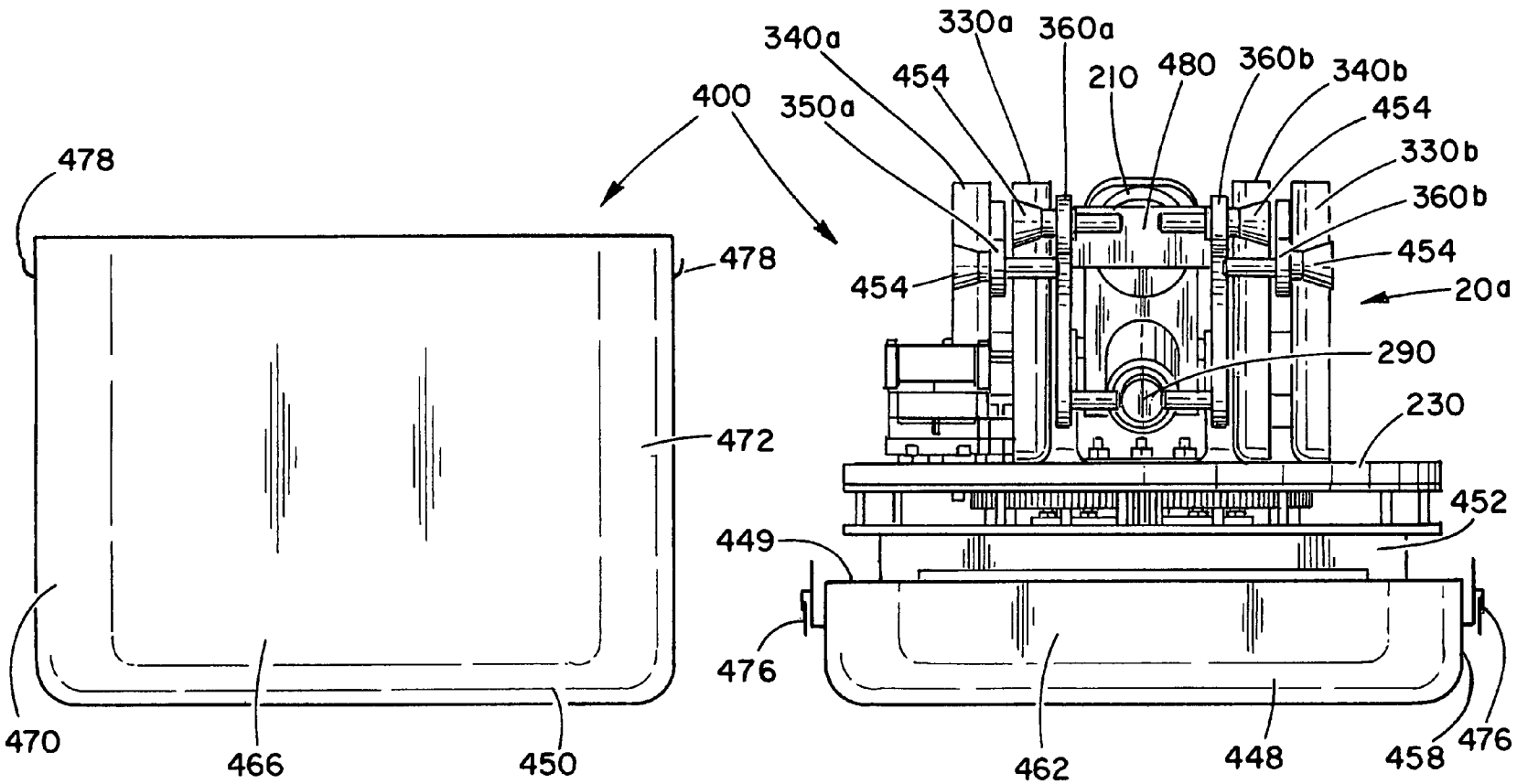
FIG. 11 is an end view of the mounted base portion and container showing the container mounting bracket.

In order to properly transport or store the portions 20*a* and 20*b* of the satellite antenna system 20, two luggage-type containers 400, 900 can be provided for internally mounting and supporting the separated portions 20*a* and 20*b* of the satellite antenna system 20. As shown in FIGS. 9-11, a first transportable container 400 can be provided which is divided into two sections 448 and 450 to stow portion 20*a*. The bottom section 448 is relatively shallow and has a mounting bracket 452 mounted within the bottom section 448 around the inner perimeter and elevated slightly above the upper edge 449 of the container. The bottom section 448 includes the bottom surface 456 as well as the ends 460, 462 and sides 458, 464. The top section 450 is considerably greater in height to accommodate the base portion 20*b* of the satellite antenna system 20 and has a top surface 464, ends 466, 468 and sides 470, 462. Quick release latches 476 on the bottom section 448 are complimentary to and positioned to connect with corresponding latches 478 on the upper section 450. The two sections naturally are sized to fit together with the latches 476, 478 holding the sections together in a secure weatherproof and contamination free environment.

The azimuth plate 230 can be suitably mounted and attached to a mounting bracket 452 secured (such as with rivets or the like) within the bottom section 448. In this embodiment, the bottom section 448 of the container serves as the base for the elevation mechanism 200 and the deployed satellite antenna system. Alternatively, portion 20*a* of the satellite antenna system 20 could be designed to be removable from the bottom section 448 of the container.

The free ends of the linkage bars 350 and 360 can optionally be secured (not shown) to the mounting bracket 452 to securely hold these arms to prevent their movement within the container during transportation. In another embodiment, they are not secured, but foam padding inserts can be used.

Figure 12:
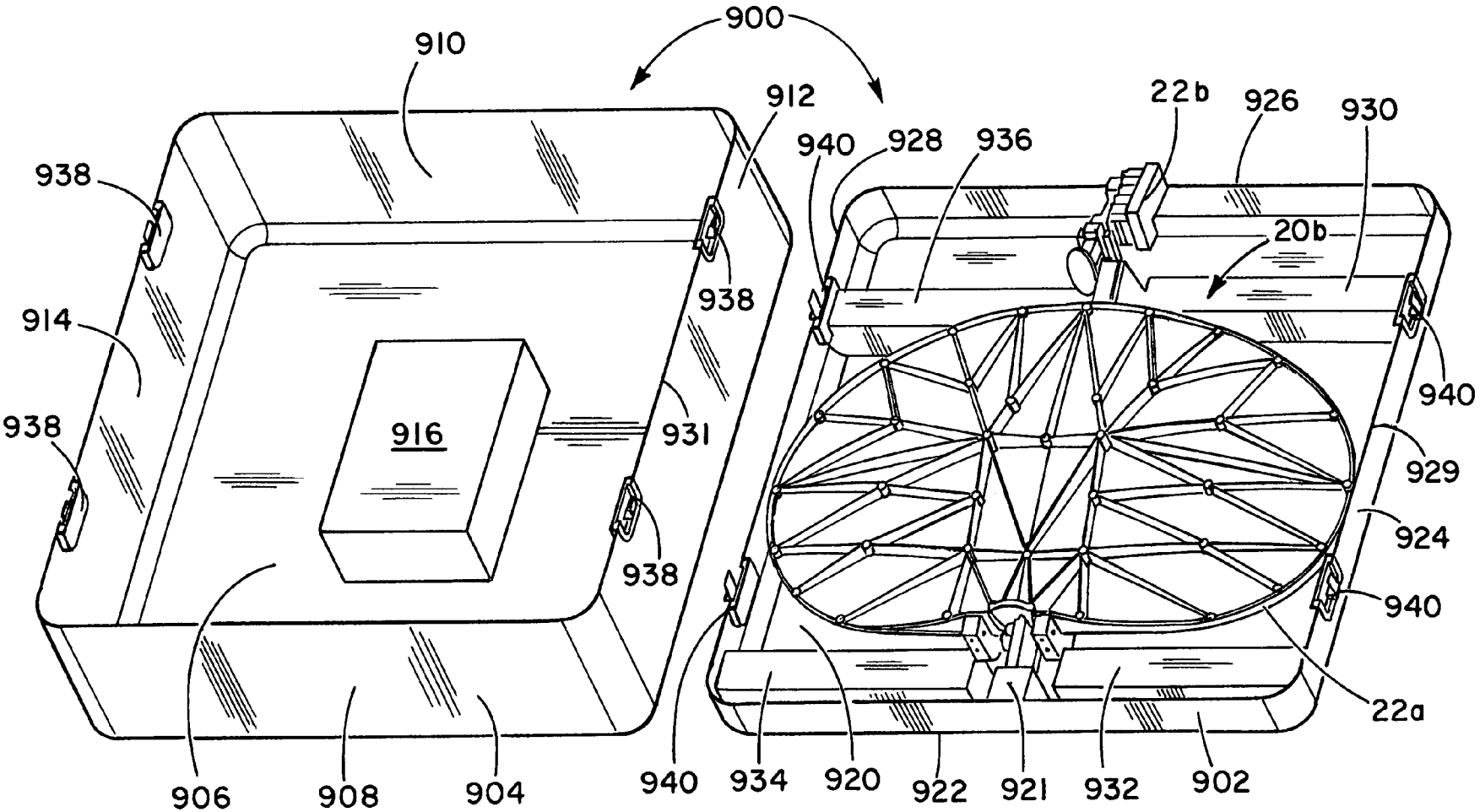
FIG. 12 is a perspective view of the separated dish antenna portion of the satellite antenna system of the present invention mounted within a second transportable container.
Figure 13:
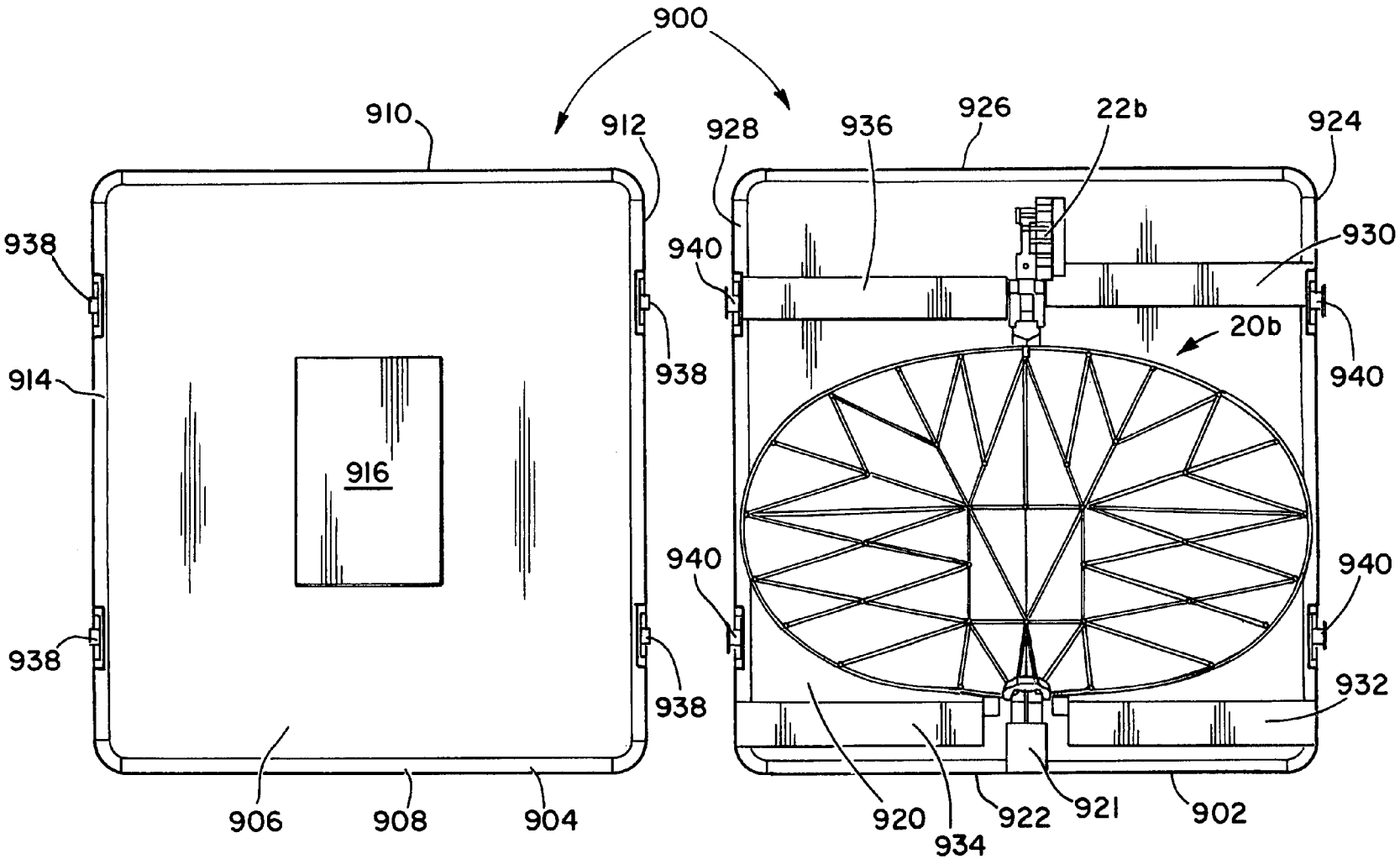
FIG. 13 is a top plan view of the open second transportable container showing the dish back plate mounted within one portion of the container.
Figure 14:
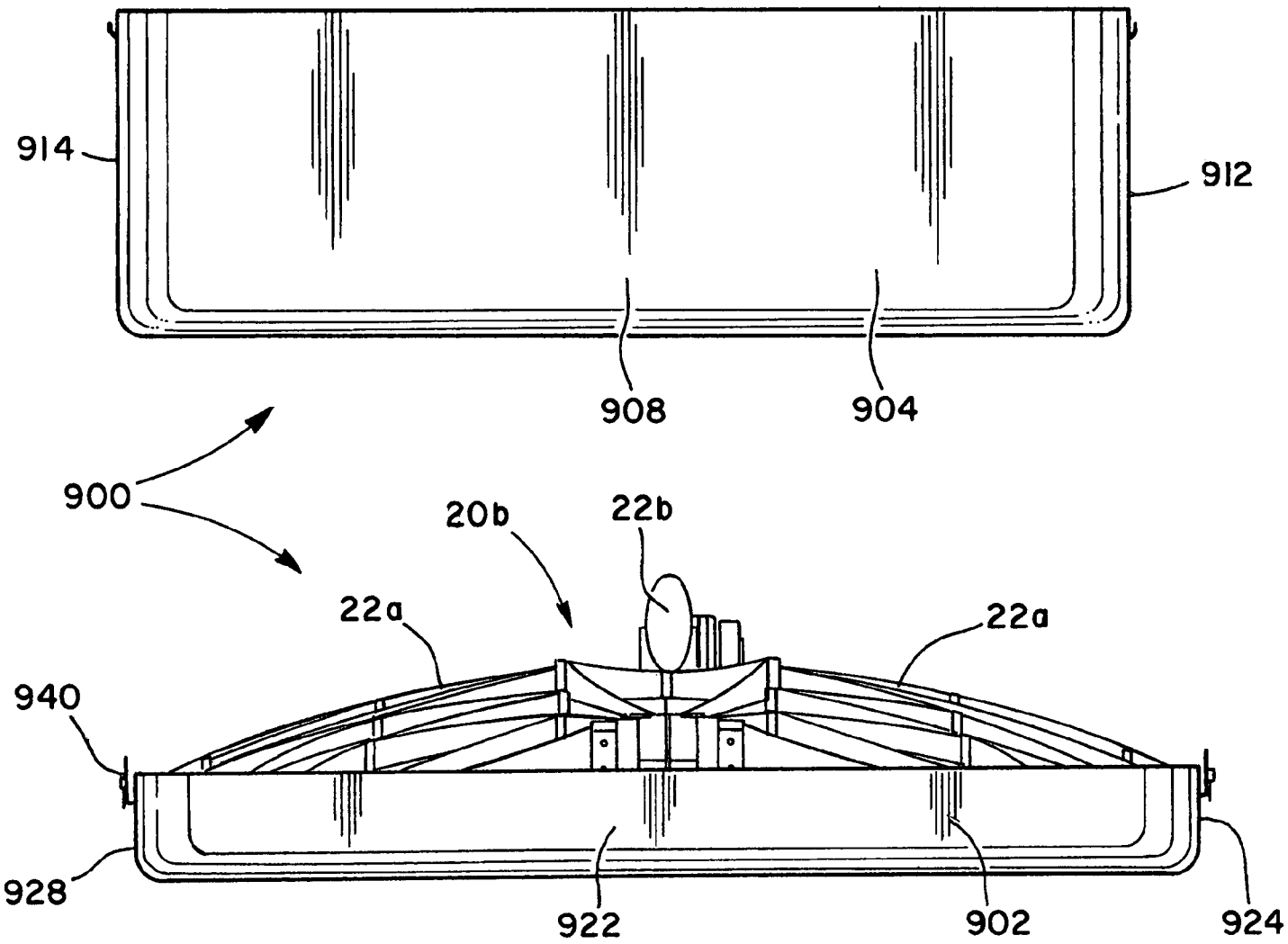
FIG. 14 is a side elevation view of the second transportable container of FIG. 13 showing the dish back plate mounted within the container.

As shown in FIGS. 12-14, the second transportable container 900 for stowing portion 20*b* separates into a first section 902 and a second section 904. The first section 902 is considered to be the base and has a bottom surface 920 and ends 922, 926 and sides 924, 928. The sides and ends are shallow with the upper edge 929 of the first section 902 extending a short distance vertically above the bottom surface 920. A plurality of quick release latches are spacedly positioned along the upper edge 929 on both of the sides 928, 924. The second section of the transportable container 900 includes the top surface 906, ends 908, 910 and sides 912, 914. The height of the ends 908, 910 and sides 912, 914 are considerably greater than the height of the ends and sides of the first section 902. The overall height provided in the second transportable container 900 is predetermined so that it can accommodate and provide clearance for the dish back support structure 22*a*, the dish back plate 300 and skew plate 310 which forms the dish portion 20*a* of the separated satellite antenna system 20. Mounting pads 930, 932, 934 and 936 can be strategically located within the lower section 902 of the transportable container 900. Suitable brackets, catches and latches 921 can be provided for properly supporting and mounting the dish back support structure 22*a* and its associated components.

It is be understood throughout this application that where reference is made to the dish back support structure 22*a* it is also understood that the actual dish antenna 22 is mounted on the obverse side. It is intended that the width, length and height of the transport container 900 will be sized to accommodate the dish antenna 22 of the present satellite antenna system. It is well known that the antenna itself can of any size that is required for reception of the satellite signals that are intended to be received.

Various stabilization blocks and pads such as the block 916 attached to the inside surface of the top surface 906 of the upper section 904 of the transport container 900 can be provided on the surfaces of both sections of the container to support and stabilize the dish antenna components that are mounted within the bottom section 902 of the container. These blocks and stabilizers can be fabricated from various types of resilient materials which can be positioned against various surfaces of the satellite antenna components in order to hold them securely within the container to prevent movement and possible damage. It is to be expressly understood that the containers 400 and 900 are made from any conventional suitable lightweight, strong material available from a number of manufacturers.

Figure 15:
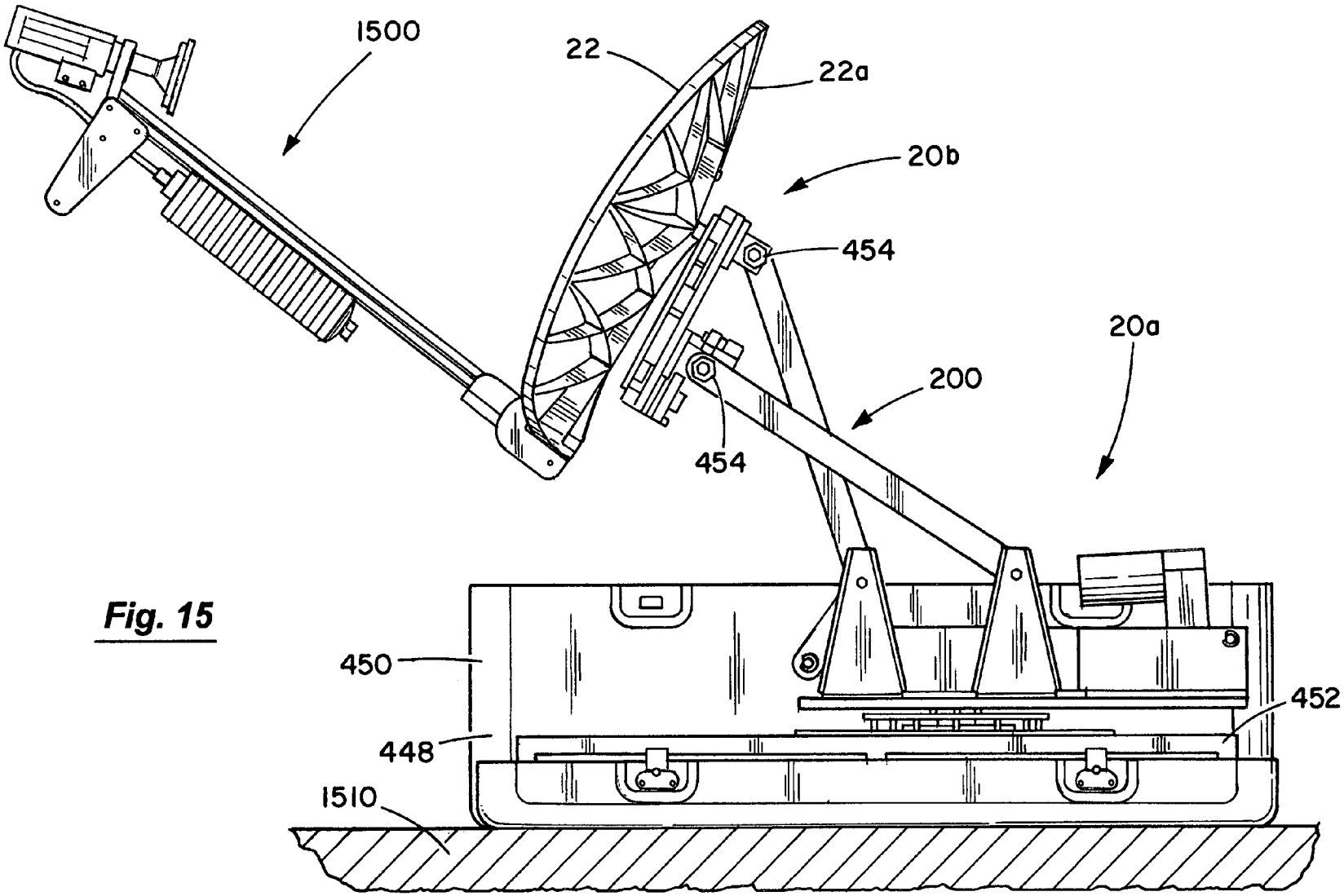
FIG. 15 is a side elevation view of one embodiment of the satellite dish system of the present invention deployed on the bottom section one of the transportable containers.
Figure 16:
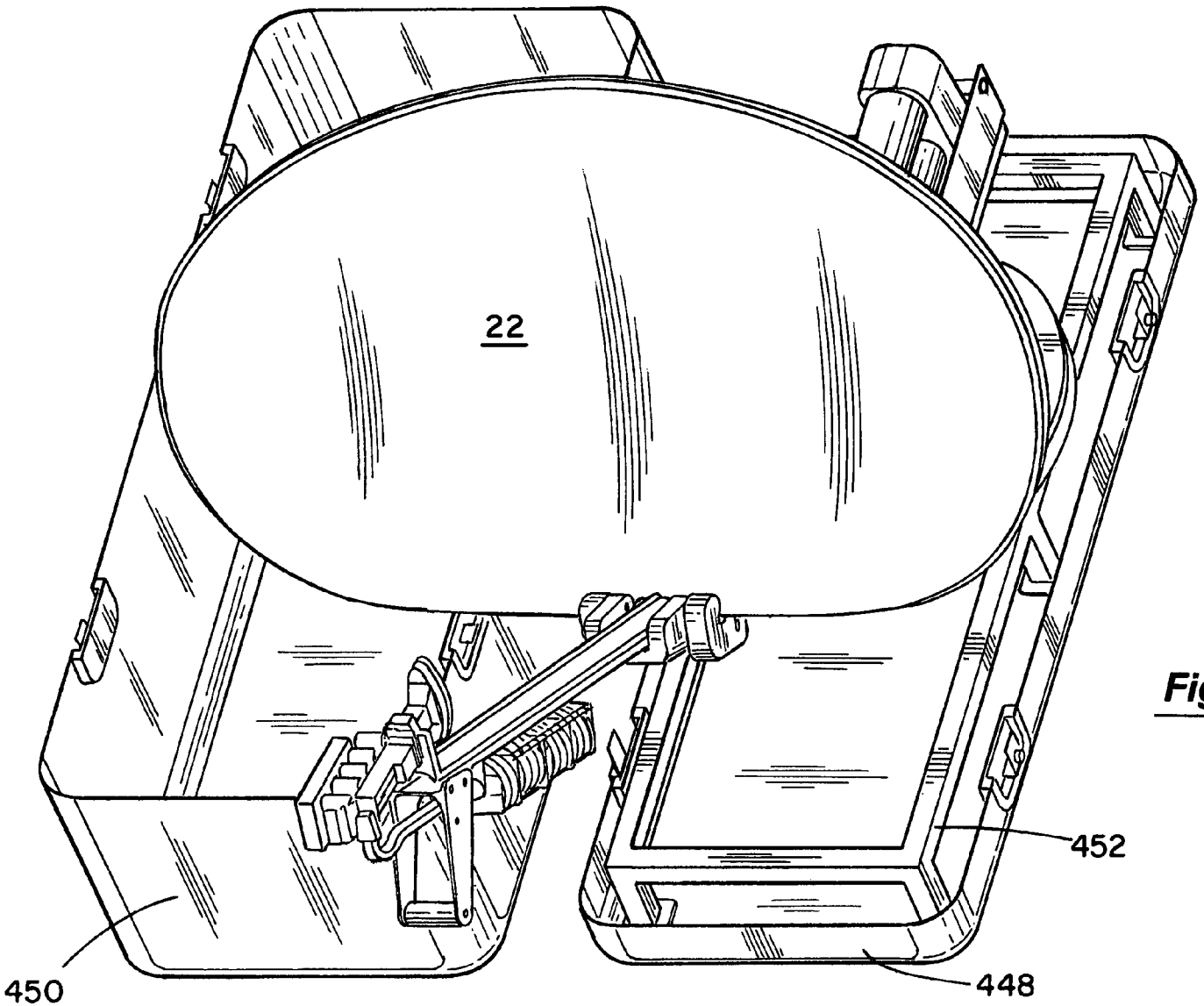
FIG. 16 is a front perspective view of the deployed satellite antenna system of FIG. 15.

Deployment Using Transportable Container. In FIGS. 15 and 16, another embodiment of the present invention is set forth wherein the bottom section 448 of the first transportable container 400 is used as the bottom support for the deployed antenna of the present invention in operation on ground 1510. In this embodiment, the quick-connect fasteners 454 are used to rapidly connect the two portions 20*a* and 20*b* together to form the antenna system 20 of the present invention. The LNBs and associated electronics 1500 and cabling can then be quickly attached such as discussed for the embodiment of FIG. 1. In FIGS. 15 and 16, only four releasable fasteners 452 are required to connect portion 20*a* to portion 20*b* of the satellite antenna system 20 of the present invention.

Figure 8:
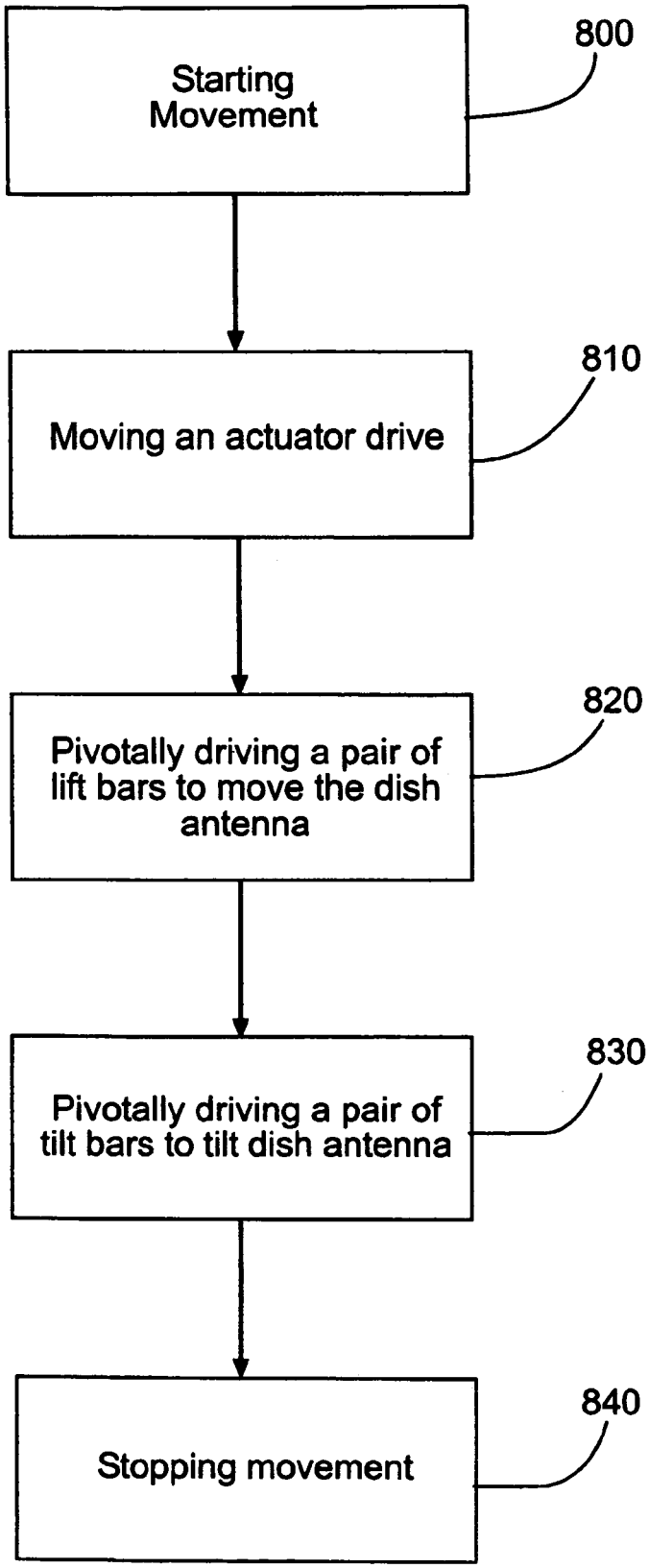
FIG. 8 is a flow diagram of the method of the present invention.

Method. In FIG. 8, the method of the present invention is set forth. In FIG. 8, when it is desired to deploy the satellite antenna system 20 from a stowed position (or vice versa), the user provides a suitable input 110 to the computer 100 (as shown in FIG. 1) to start movement 800. The linear actuator 210 is activated in stage 810 to move the actuator drive 220 in the desired direction. The movement of the actuator drive 220 causes the pivotal driving 820 of the pair of lift bars 360*a* and 360*b* to move the dish 22 (for example arrow 700 in FIG. 7) and to provide a corresponding pivotal driving 830 on the pair of tilt pivot bars 350*a* and 350*b* to cause the satellite antenna system 20 to tilt (as shown by, for example, arrow 710 in FIG. 7). Once at the desired location, in stage 840 the linear actuator 210 is deactivated.

The quick release method of the present invention for stowing and transporting a mobile satellite antenna 20 of the present invention comprises the following steps. In one embodiment, the quick-connect fasteners 454 are released so as to free the second portion 20*b* of the dish antenna system 20 from the first portion 20*a* of the satellite dish antenna system 20. The first portion 20*a* of the satellite dish antenna 20 having the elevation mechanism 200 is secured in the bottom section 448 of a first transportable container 400 to a mounting bracket 452. The top section 450 of the first transportable container is secured over the bottom section 448 and the first portion 20*a* is stowed and ready for shipment. The second portion 20*b* of the dish antenna 20 containing the satellite dish 22 is placed into the bottom section 902 of the second transportable container 900 and the top section 904 of the second transportable container 900 is secured to the bottom section 902, to safely enclose the second portion of the dish antenna 20 within the second transportable container 900. The second transportable container is then ready for transportation.

Once at the desired location, the method is reversed with the top sections of both transportable containers removed. The bottom section 448 of the first transportable container 400 serves as the support structure for the satellite dish antenna of the present invention for use when deployed. The second portion 20*b* having the satellite dish 22 is removed from the second transportable container 900 and quickly installed to the elevation mechanism 200 using quick connect fasteners 454. The remainder of the satellite dish antenna 20 containing the LNB and electronics 1500 are attached. The satellite dish antenna 20 is fully assembled and ready for operation with suitable interconnections to power and control electronics.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following. The following claims articulate some of the inventive concepts of the present invention and it is to be expressly understood that such articulations do not limit the intended scope of the invention.

I claim:

1. A mobile satellite antenna system comprising:

a first portion of the satellite antenna system having an elevation mechanism;

a second portion of the satellite antenna system having a dish with a dish back support structure;

quick-connect fasteners for selectively fastening the elevation mechanism of the first portion to the dish back support structure of the second portion; and a first transportable container for containing the first portion of the satellite antenna system.

2. The system of claim 1 wherein the first transportable container has a top section and a bottom section and wherein the bottom section comprises:

a mounting bracket; and said first portion attaches to said mounting bracket in said transportable container so that when the top section of the first transportable container is removed, said second portion can be connected to said first portion with said quick-connect fasteners thereby deploying said satellite antenna system using the bottom section of the first transportable container as a base for the deployed satellite antenna system.

3. The system of claim 2 wherein the first portion of the satellite antenna system further comprises an azimuth plate attached to the mounting bracket of the bottom section of the first transportable container.

4. The system of claim 3 wherein the elevation mechanism comprises linkage bars extending from the azimuth plate to the dish back support structure of the second portion when the satellite antenna system is deployed.

5. The system of claim 1 further comprising a second transportable container for storing the second portion of the satellite antenna system.

6. The system of claim 5 wherein the second transportable container further comprises a bottom section for storing the second portion of the satellite antenna system, and a top section securable to the bottom section to enclose the second portion of the satellite antenna system.

7. A quick-release method for transporting a mobile satellite antenna system, said method comprising:

removing quick-connect fasteners to disconnect an elevation mechanism of a first portion of a satellite antenna system from a second portion of the satellite antenna system having dish and a dish back support structure;

removably securing a top section of a first transportable container over bottom section of the first transportable container to enclose the first portion of the satellite antenna within the first transportable container;

placing the second portion of the satellite antenna system into a bottom section of a second transportable container; and removably securing a top section of the second transportable container to the bottom section of the second transportable container to enclose the second portion of the satellite antenna system within the second transportable container.

8. A mobile satellite antenna system comprising:

a first transportable container having a top section and a bottom section;

a first portion of the satellite antenna system having an elevation mechanism secured to the bottom section of the first transportable container;

a second portion of the satellite antenna system having a dish with a dish back support structure;

quick-connect fasteners for selectively fastening the elevation mechanism of the first portion to the dish back support structure of the second portion;

wherein the top section of the first transportable container is removably securable to the bottom section to enclose the first portion of the satellite antenna system within the first transportable container.

9. The system of claim 8 further comprising an azimuth plate mounted to the bottom section of the first transportable container and supporting the elevation mechanism.

10. The system of claim 9 wherein the elevation mechanism comprises linkage bars extending from the azimuth plate to the dish back support structure of the second portion when the satellite antenna system is deployed.

11. The system of claim 8 further comprising a second transportable container for storing the second portion of the satellite antenna system.

12. The system of claim 11 wherein the second transportable container further comprises a bottom section for storing the second portion of the satellite antenna system, and a top section securable to the bottom section to enclose the second portion of the satellite antenna system.

* * * * *